US012690649B2

(12) United States Patent
Stella

(10) Patent No.: US 12,690,649 B2
(45) Date of Patent: Jul. 28, 2026

(54) VENTED CANOPY SYSTEM FOR UMBRELLAS

(71) Applicant: Michael Stella, Easley, NC (US)

(72) Inventor: Michael Stella, Easley, NC (US)

( * ) Notice: Subject to any disclaimer, the term of this patent is extended or adjusted under 35 U.S.C. 154(b) by 213 days.

(21) Appl. No.: 18/624,013

(22) Filed: Apr. 1, 2024

(65) Prior Publication Data

US 2025/0302162 A1 Oct. 2, 2025

(51) Int. Cl.

| | |
|---|---|
| ***A45B 25/22*** | (2006.01) |
| ***A45B 25/02*** | (2006.01) |
| *A45B 23/00* | (2006.01) |
| *A45B 25/18* | (2006.01) |

(52) U.S. Cl.

CPC ..... *A45B 25/22* (2013.01); *A45B 25/02* (2013.01); *A45B 2023/0012* (2013.01); *A45B 2025/186* (2013.01)

(58) Field of Classification Search

CPC ..... A45B 25/22; A45B 2025/186; A45B 2200/1036

USPC ..... 135/33.7, 93, 94

See application file for complete search history.

(56) References Cited

U.S. PATENT DOCUMENTS 3,456,661 A * 7/1969 Farley ..... A45B 25/22 135/33.7
4,865,063 A * 9/1989 Williams ..... A45B 25/20 135/33.7
5,890,506 A * 4/1999 Kupferman ..... A45B 25/22 135/33.7
6,170,499 B1 * 1/2001 Lin ..... A45B 25/18 135/33.7
6,202,662 B1 * 3/2001 Lin ..... A45B 25/22 135/33.7
7,448,399 B2 * 11/2008 Song ..... A45B 25/20 135/33.7
11,766,102 B2 * 9/2023 Garrison ..... A45B 23/00 135/94
2002/0056472 A1 * 5/2002 Nanus ..... A45B 25/22 135/33.7
2002/0134412 A1 * 9/2002 You ..... A45B 25/22 135/33.7
2004/0149327 A1 * 8/2004 You ..... A45B 25/22 135/33.7
2005/0066591 A1 * 3/2005 Worley ..... E04H 15/16 52/138
2008/0223423 A1 * 9/2008 Kupferman ..... A45B 25/18 135/33.7

(Continued)

*Primary Examiner* — Robert Canfield

(74) *Attorney, Agent, or Firm* — William Simmons; Simmons Patents

(57) ABSTRACT

A vented canopy system for an umbrella includes a trim attached to an outer edge of an umbrella support structure defining a central opening. A breathable support layer is disposed across the central opening. A plurality of layered canopy sections are positioned over the breathable support layer, where upper canopy sections partially overlap lower canopy sections. An inside edge of each canopy section is secured to the umbrella support structure. An outside edge of each canopy section includes a tether configured to permit the outside edge to move away from the breathable support layer in response to fluid pressure and prevent the canopy section from inverting, such that the canopy section returns to a baseline position upon a reduction in fluid pressure.

20 Claims, 9 Drawing Sheets

(56) References Cited

U.S. PATENT DOCUMENTS

| | | | | |
|---|---|---|---|---|
| 2009/0235965 | A1* | 9/2009 | Kupferman | A45B 25/18<br>135/33.7 |
| 2010/0258151 | A1* | 10/2010 | Vogt | A45B 25/20<br>135/33.7 |

* cited by examiner

Prior Art
Umbrella Frame

Bottom Plan View

Bottom Plan View

TOP PLAN VIEW

VENTED CANOPY SYSTEM FOR UMBRELLAS

FIELD OF THE INVENTION

The current invention pertains to a canopy system device and method designed to offer a wind-resistant umbrella. In specific instances, this invention finds application in scenarios like beach umbrellas and patio umbrellas, where the risk of being carried away by strong winds is a concern.

BACKGROUND OF THE INVENTION

During the summer, beaches and outdoor venues attract many people seeking leisure. Often, individuals require accessories such as umbrellas to create shade while enjoying these locations. Specifically, a beach umbrella, characterized by its large size, is crafted to offer sun protection. Typically featuring a diameter ranging from 6 to 10 feet, these umbrellas are constructed from robust, weather-resistant materials like polyester or canvas. Mounted on a pole made of lightweight, rust-resistant materials such as aluminum or fiberglass, they facilitate easy transportation. Beach umbrellas exhibit a diverse range of colors and patterns, often vibrant and lively, reflecting the carefree atmosphere of beach outings. Frequently seen on beaches, these umbrellas serve as popular spots for cool and shaded relaxation.

The pole of beach umbrellas often features a pointed end intended for easy insertion into the sand. However, it is essential to recognize that winds on a beach can exceed 20 mph, if not more. In the event that the wind catches a beach umbrella at the right angle, there is a risk of it getting dislodged from the sand and turning into a wind-propelled projectile.

In contemporary umbrella designs found in the prior art, the top often incorporates a vented structure to permit wind passage, mostly to release heat but also to reduce the likelihood of the umbrella being carried away. Nevertheless, these conventional venting methods have proven insufficient in certain wind conditions. Consequently, injuries stemming from beach umbrellas are not uncommon, and some cases even lead to fatalities. Data from the US Consumer Product Safety Commission (CPSC) reveals that between 2008 and 2017, more than 31,000 individuals sought hospital treatment for injuries related to umbrellas. Approximately 3,000 people are hospitalized each year, with instances of fatalities, particularly when individuals are impaled in the chest by the sharp ends of traditional beach umbrella poles.

It is important to recognize that occurrences of high gusts of wind are relatively infrequent. Consequently, for the majority of an umbrella's lifespan, its primary function will be to provide shade and, ideally, maintain an aesthetically pleasing appearance. Therefore, any venting technology implemented should minimally impact the visual appeal of the umbrella.

If prior art umbrellas with venting technology are being dislodged by high winds and causing injuries and deaths, the venting technology is clearly not adequate for such wind conditions. Therefore, the need exists for an improved apparatus and method for venting umbrellas that is low-cost, reliable and does not materially affect the umbrella's aesthetics.

BRIEF DESCRIPTION OF THE INVENTION

Aspects and advantages of the invention are set forth below in the following description, or may be obvious from the description, or may be learned through practice of the invention.

One embodiment of the present invention is a vented canopy system for minimizing the risk of an umbrella taking flight under a gust of wind. The system may include a trim that attaches to an umbrella support structure's outer edge, leaving an opening in the middle. A breathable support layer covers this opening, allowing air to pass through while still providing support. The system may have several layered canopy sections disposed on top of the breathable support layer. Each layered section covers part of the open space in the middle, with upper sections overlapping lower sections. The inside edge of each section is attached to the umbrella frame, and the outside edge has a tether (like a string) that allows it to flip up in the wind but prevents it from flipping all the way over.

Additional objects and advantages of the present invention are set forth in the detailed description herein or will be apparent to those skilled in the art upon reviewing the detailed description. Also, it should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

By reviewing the rest of the specification, those of ordinary skill in the art will gain a deeper understanding of the features, aspects, and benefits described in these embodiments.

BRIEF DESCRIPTION OF THE DRAWINGS

The remainder of this specification provides a detailed and enabling disclosure of this invention. It includes explanations of the best mode, along with references to the accompanying figures for further clarity, in which.

Figure 1:
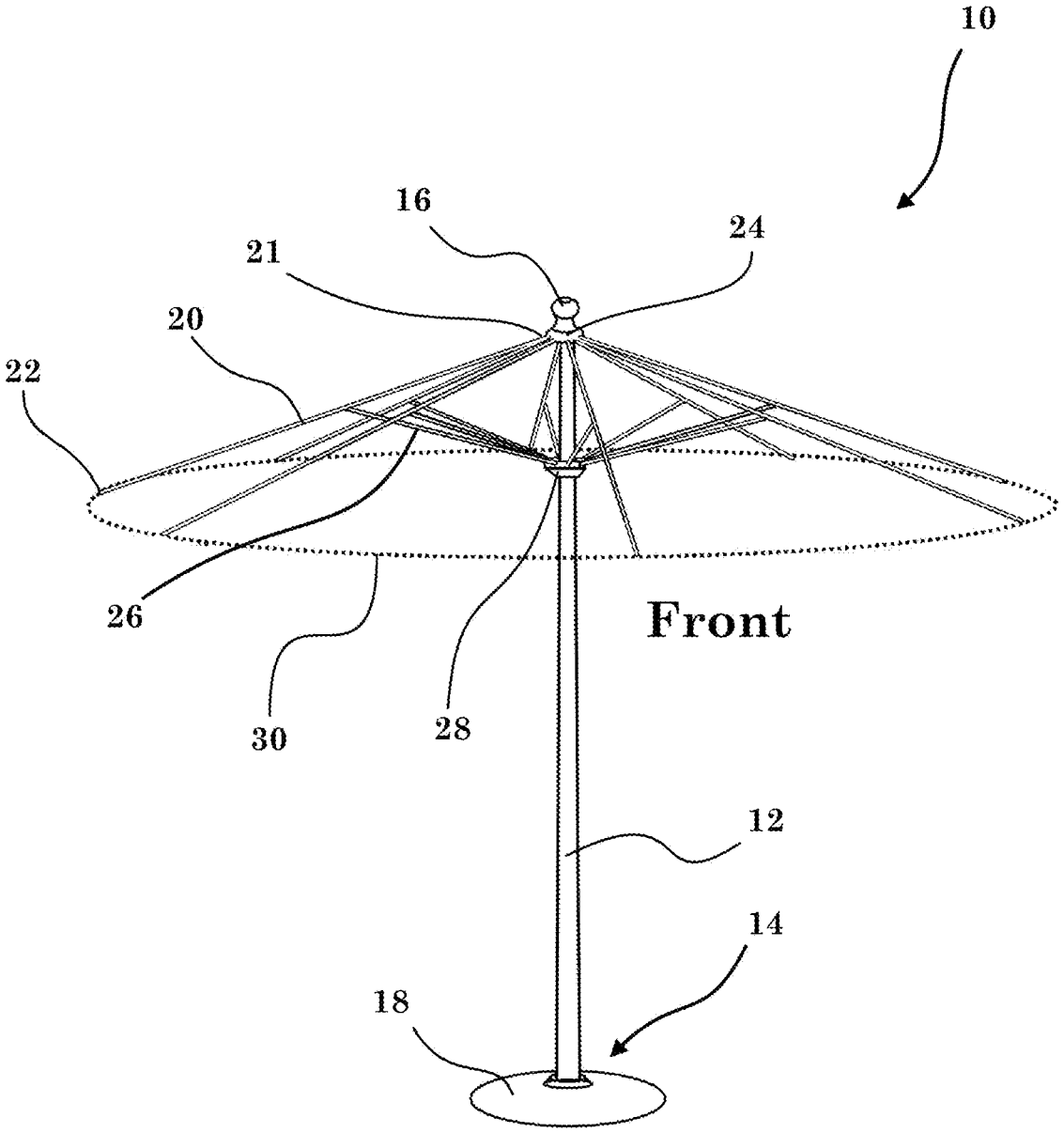
FIG. 1 is a side view of a prior art umbrella frame for supporting a canopy.

is an end elevation view of the apparatus shown in FIG. 1; and

Figure 6:
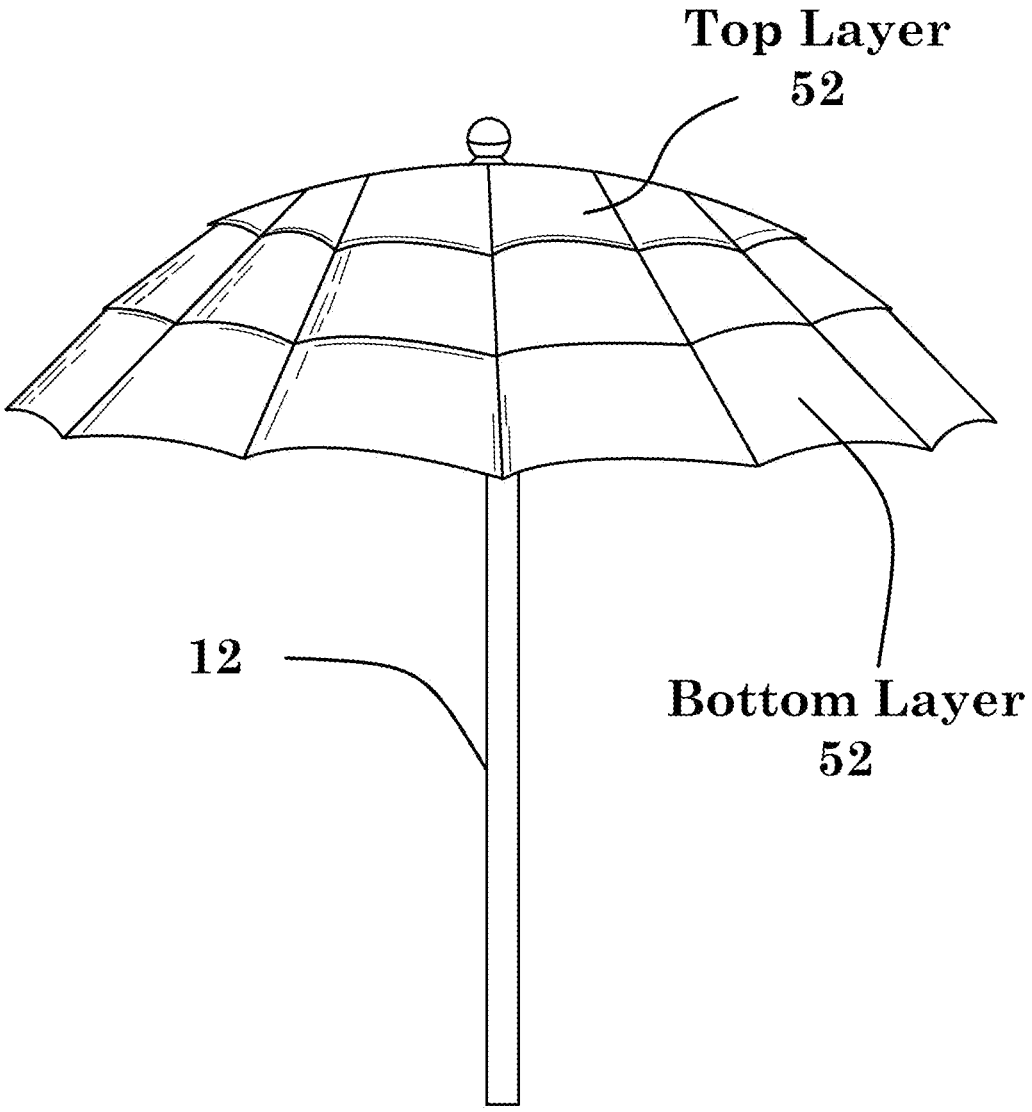
Figure 7:
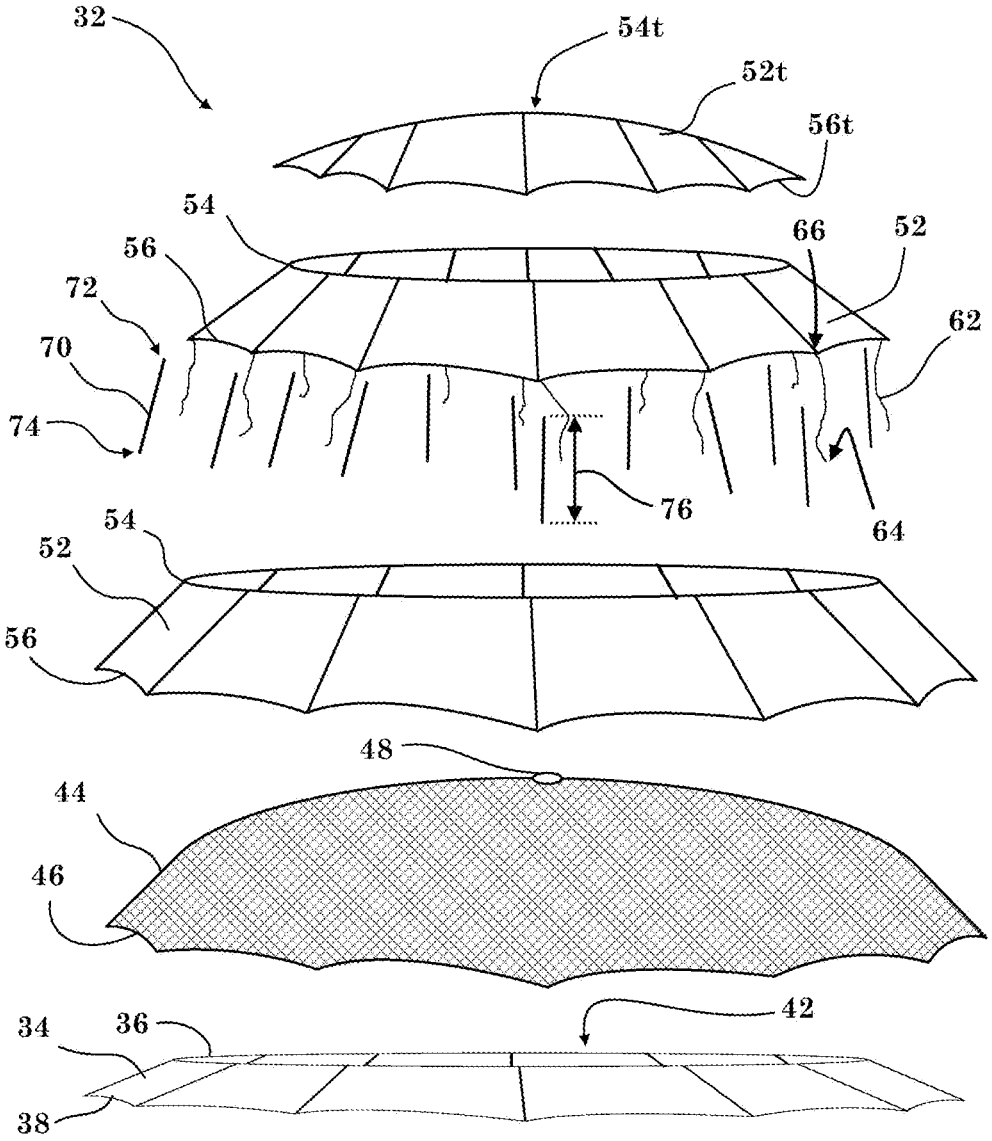
Figure 8:
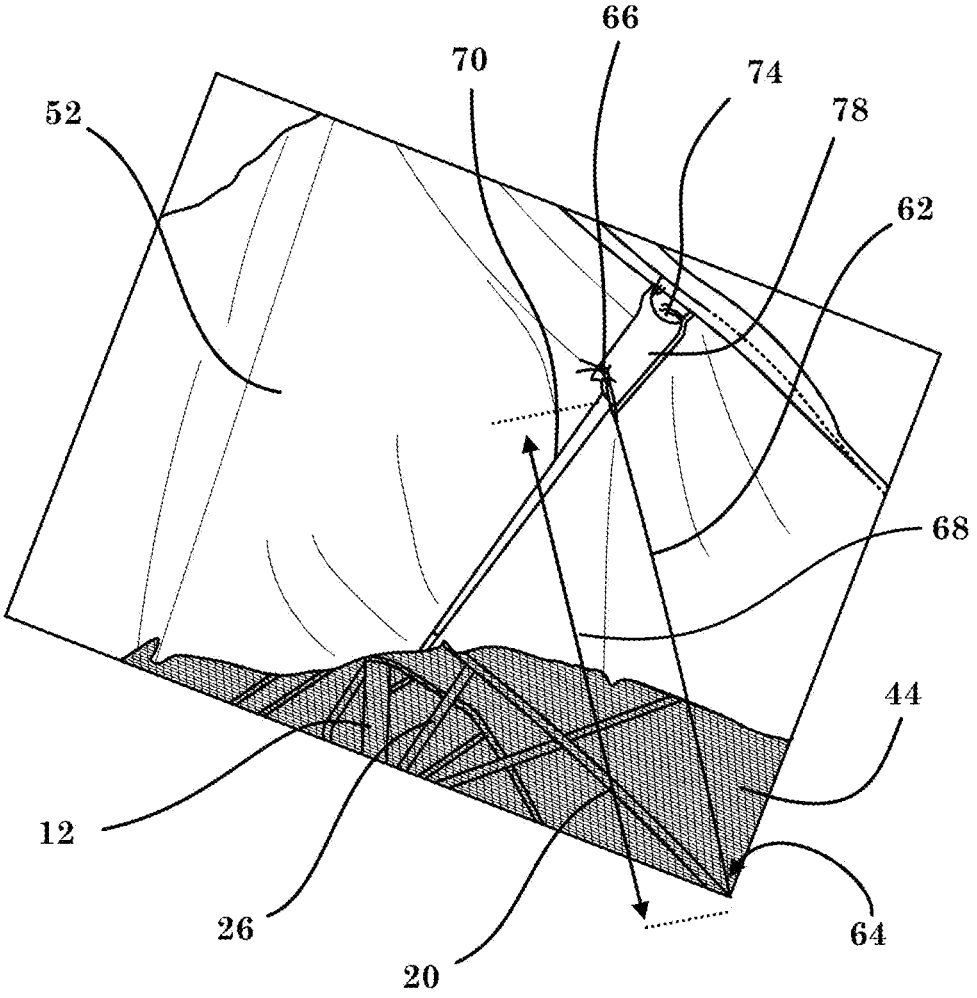
Figure 9:
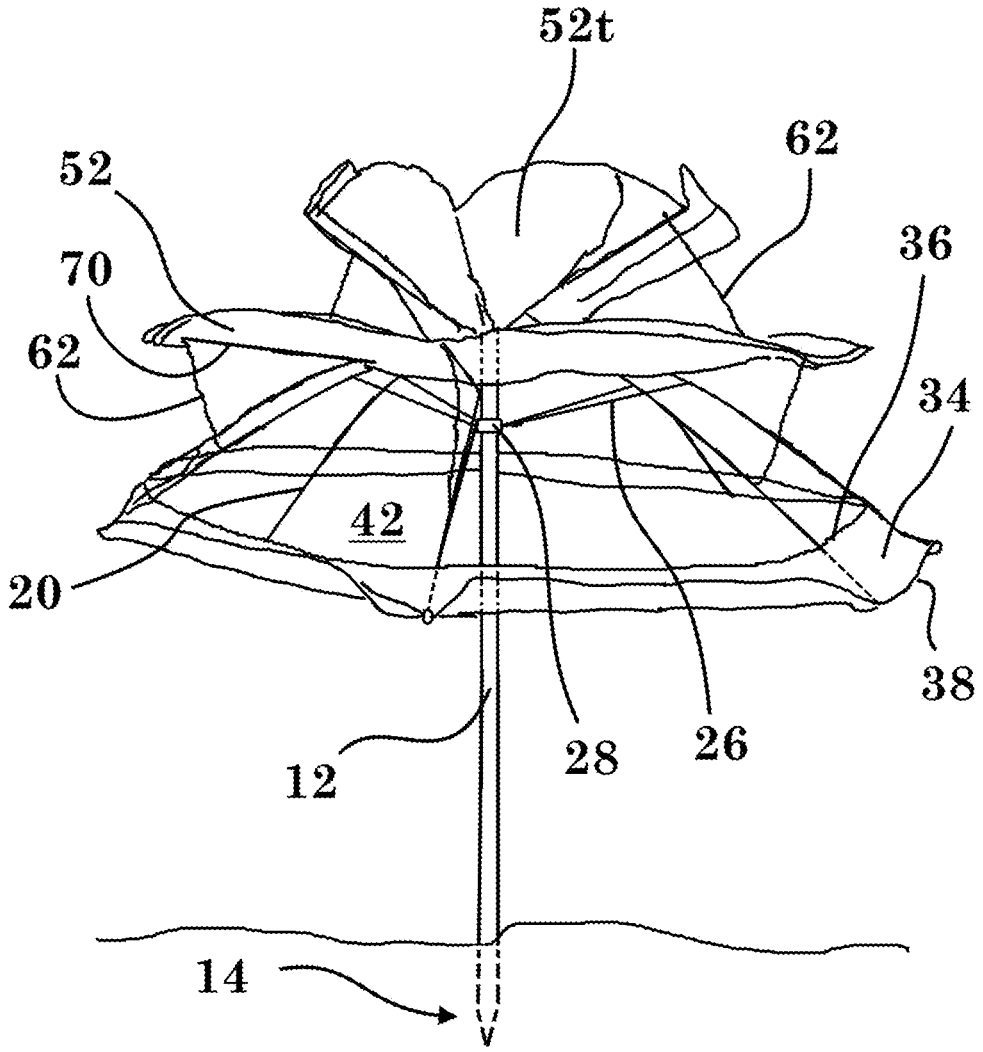

FIG. 6 is a side elevation view of a vented canopy system with no trim layer;

FIG. 7 is a side elevational exploded view of one embodiment of a vented canopy system;

FIG. 8 is a close-up view of a vented canopy system with one layer raised showing a support rod and tether; and FIG. 9 is a side elevational view of a canopy system with the canopy layers raised, thereby venting the umbrella to prevent flight.

This specification and its drawings use reference characters consistently so that the same or similar features are represented by the same character. The following discussion and drawings will provide a clear understanding of the invention's objectives, advantages, and features.

DETAILED DESCRIPTION OF THE INVENTION

This section details specific embodiments of the invention with accompanying illustrations. Features within the drawings are labeled with numbers and letters, and these labels are used consistently throughout the description. These examples are meant to clarify, not limit, the scope of the invention. Those skilled in the art will understand that the invention can be adapted and modified without straying from its core principles. Features from different embodiments can be combined to create further variations. The full scope of the invention is defined by the appended claims and their equivalents.

Hermeneutic Aids

For the purposes of this document, unless otherwise stated, the phrase "at least one of A, B, and C" means there is at least one of A, or at least one of B, or at least one of C or any combination thereof (not one of A, and one of B, and one of C).

Headers are included in this document for navigational purposes only. They do not constitute additional content, have no construction value, and should not be used to influence the interpretation of the document.

As used herein, terms "first," "second," and "third" may be used interchangeably to distinguish components, and do not imply order or hierarchy.

As used herein, the term:

"axial" refers to a direction parallel to the direction of rotation of an object;

"radial" refers to a direction extending away from the center of an object or normal to the "axial" direction, and "circumferential" refers to a direction extending around the circumference or perimeter of an object.

In this document, "about" is +/−10%, and two or more items may be "mechanically associated" if connected or related in any way. This includes:

Stationary connections such as direct, more permanent connections (e.g., welding and sewing) and releasable connections (e.g., snaps, screws, bolts etc.); and Movable connections (e.g., rotating, pivoting, oscillating, etc.).

In the claims, the definite article "said" identifies elements that are essential to define the scope of the invention's embodiments. In contrast, the definite article "the" indicates contextual elements that provide background information, but do not impose limitations on the claims. For example, "the bar" may be a contextual element, while "said bar" is a claim limitation. Additionally, references to an "object" in the preamble and claim body are intended for descriptive purposes only, and do not restrict the scope of any claim.

Description

Referring to FIG. 1, a typical prior art umbrella frame (support structure) 10 is shown. The frame 10 may include a support element 12 with a bottom end 14 and a top end 16. As depicted in FIG. 1, the support element 12 is a pole located at the center of the frame 10. The invention can be modified to accommodate multiple support elements. These elements don't have to be centrally located within the frame, but can be positioned anywhere along the frame's centerline. For example, a rectangular frame could have two support elements (12) placed at each end along its longitudinal centerline, and the invention could be adapted accordingly. The bottom end 14 may be designed for ground insertion (e.g., spear, auger, etc.) or attachment to a base 18. The top end 16 may define a canopy interface point 21 designed to receive and secure an umbrella canopy interface (defined by a canopy). Support arms 20 may extend radially outward from the support element 12 to their support arm distal ends 22 (for round frames). These arms may be pivotally connected to an upper collar 24 connected to or defined by a top portion of the support element 12. Each support arm 20 may be connected to one end of a stretcher element 26 that is pivotally connected to a lower collar 28 that may be movably associated with the support element 12 at a point below the upper collar 24. A structural perimeter or frame outer edge 30 may be defined at the support arms' distal ends 22, which may be circular, rectangular, or any polygon.

Figure 2:
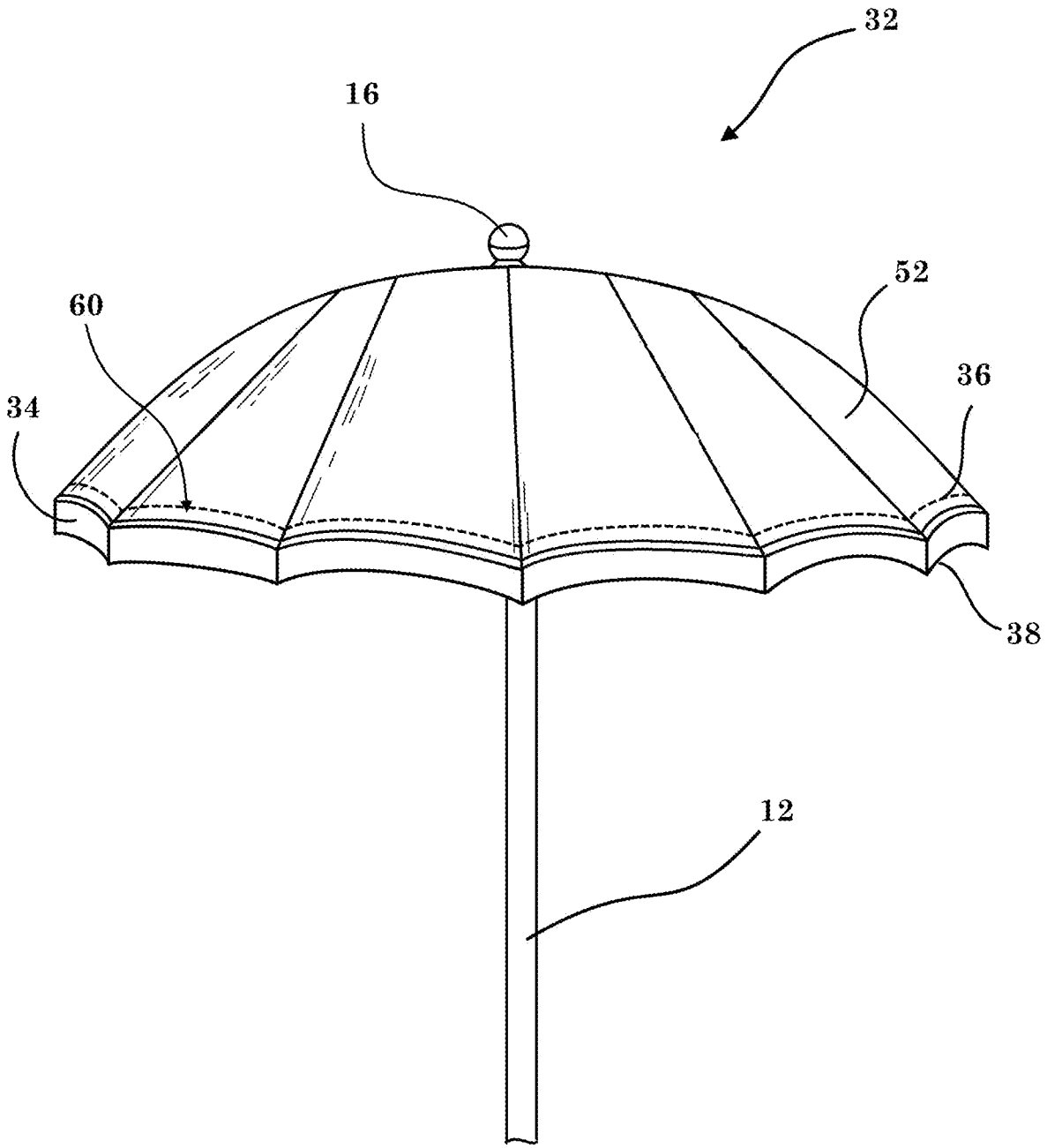
FIG. 2 is a side view of an umbrella frame associated with one embodiment of a vented canopy system according to one embodiment of the invention.

Referring now to FIG. 2, a vented canopy system 32 configured to be mechanically connected to a prior art umbrella frame 10 is presented. The VCS 32 may comprise a canopy trim 34 configured for being connected to an umbrella frame 10 having a support element 12 (such as a pole) with a plurality of support arms 20 extending outward from the support element 12 to support arm ends 22, thereby defining a frame outer edge 30 as depicted in FIG. 1. It should be appreciated that a frame outer edge 30, which could be referred to as a structural perimeter, may define any polygonal shape and the vented canopy system 32 shape would be configured to match the frame.

As depicted in the various figures, the canopy trim 34 may define an inner trim perimeter 36 and an outer trim perimeter 38 where the distance between such perimeters defines a trim width 40. For the current embodiment, the trim width 40 is between 4 inches and 12 inches. The canopy trim 34 may be configured to connect to the frame outer edge 30 (FIG. 1, FIG. 2) so that the inner trim perimeter 36 extends over a portion of the support arms 22. For such a configuration, a canopy opening 42 may be defined between the trim inner perimeter 36 (or 36*b*) as depicted in FIG. 7.

Figure 3:
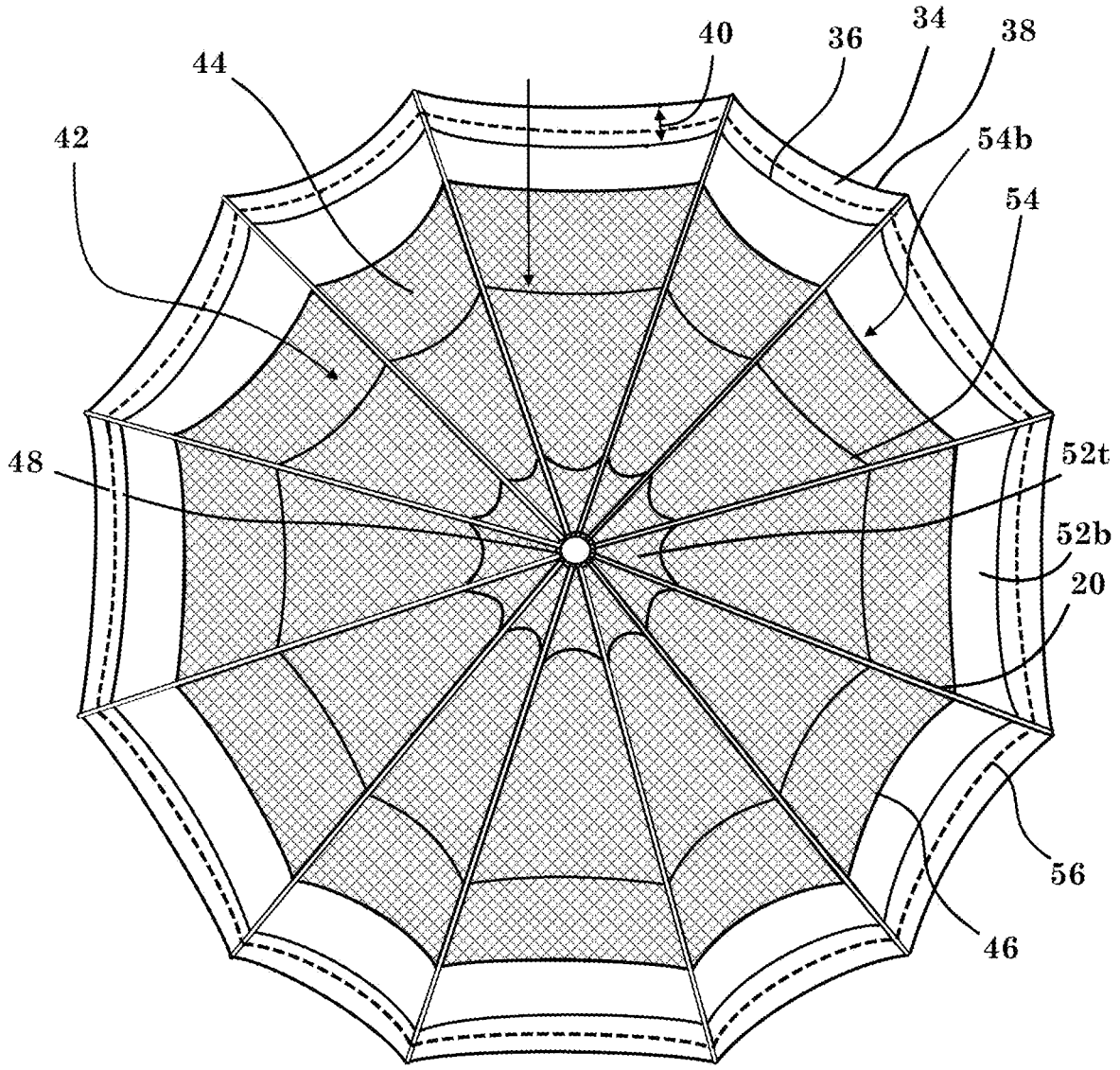
FIG. 3 is a bottom plan view of a prior art umbrella frame associated with one embodiment of a vented canopy system.
Figure 4:
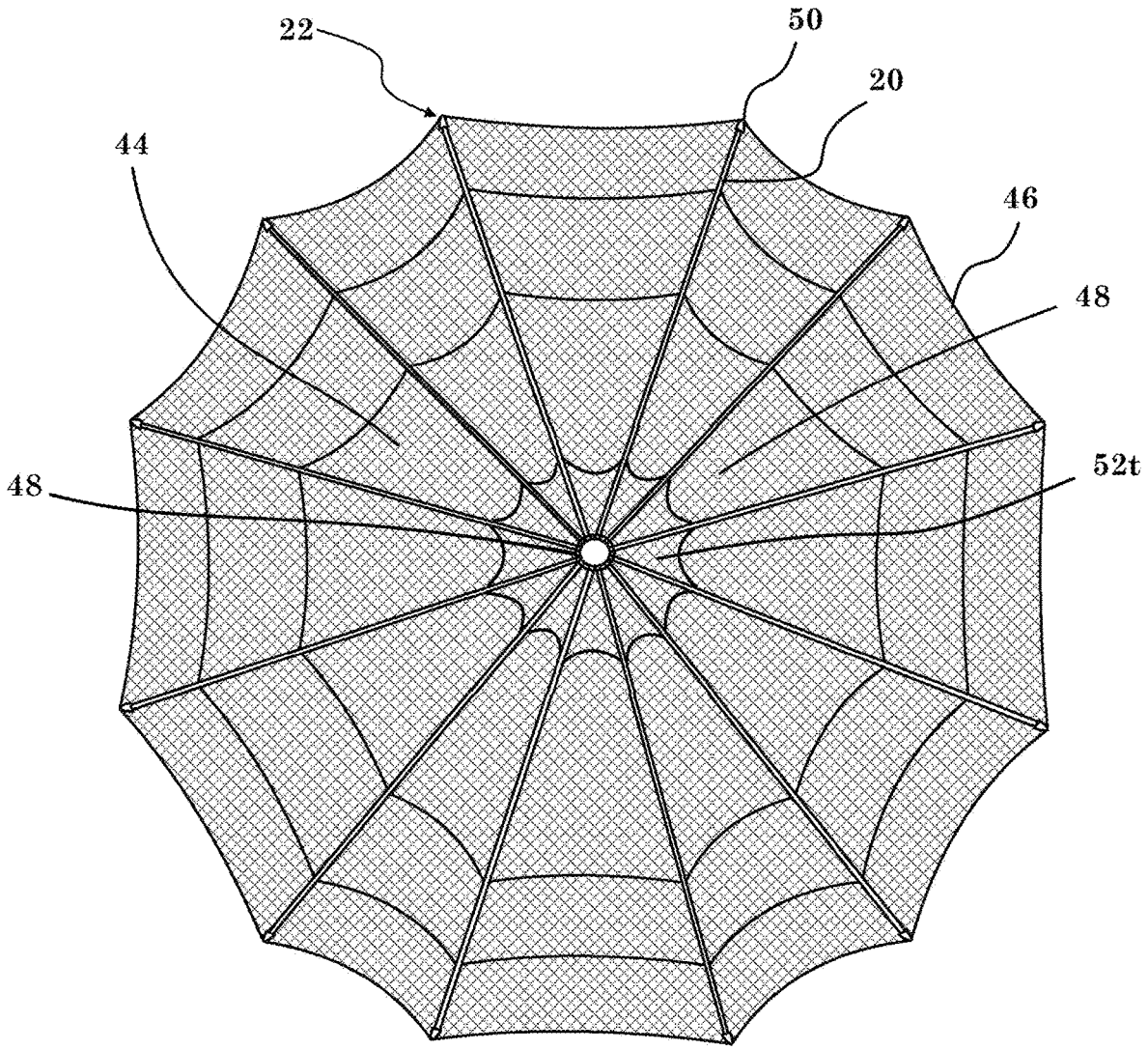
FIG. 4 is a bottom plan view of a prior art umbrella frame associated with an alternative embodiment of a vented canopy system.

The VCS 32 may further comprise a breathable support layer (BSL) 44, defining a support layer outer perimeter 46 (FIGS. 3, 4 and 7) and an inner support layer perimeter 48 (FIG. 4). The BSL 44 inner support layer perimeter 48 may be configured to attach to the umbrella frame 10 at the support element 12 (canopy interface point 21) and expand outward over said canopy opening 42 and connect to at least one of the inner trim perimeter 36 or a point between the inner trim perimeter 36 and the outer trim perimeter 38. Similarly, the BSL may connect to the inner canopy layer perimeter 54 (FIG. 3) for a bottom layer 52*b* or a point between the inner canpop layer perimeter 54 and the outer canopy layer perimeter 56. For an alternative embodiment, the BSL 44 outer perimeter 46 may be attached to the frame 10, perhaps at the support distal ends 22 or some location between the support distal ends 22 and the inner trim perimeter 36. The BSL 44 may also be connected to a canopy section element and the umbrella frame 10. As noted above and shown in FIG. 4, the BSL 44 extends all the way to the support arm distal ends 22 and is connected by end caps 50.

For one alternative embodiment, the inner trim perimeter 36 is connected directly to the BSL 44 outer perimeter with no overlap, and they may form one integrated component without departing from the scope and spirit of the invention.

The breathable support layer 44 is configured to allow air to pass through while providing support to upper canopy layers. Suitable materials for the breathable support layer 44 include a cargo netting, knotted netting, knotless netting, polyester debris fabric, shade cloth, or a mesh fabric material.

Figure 5:
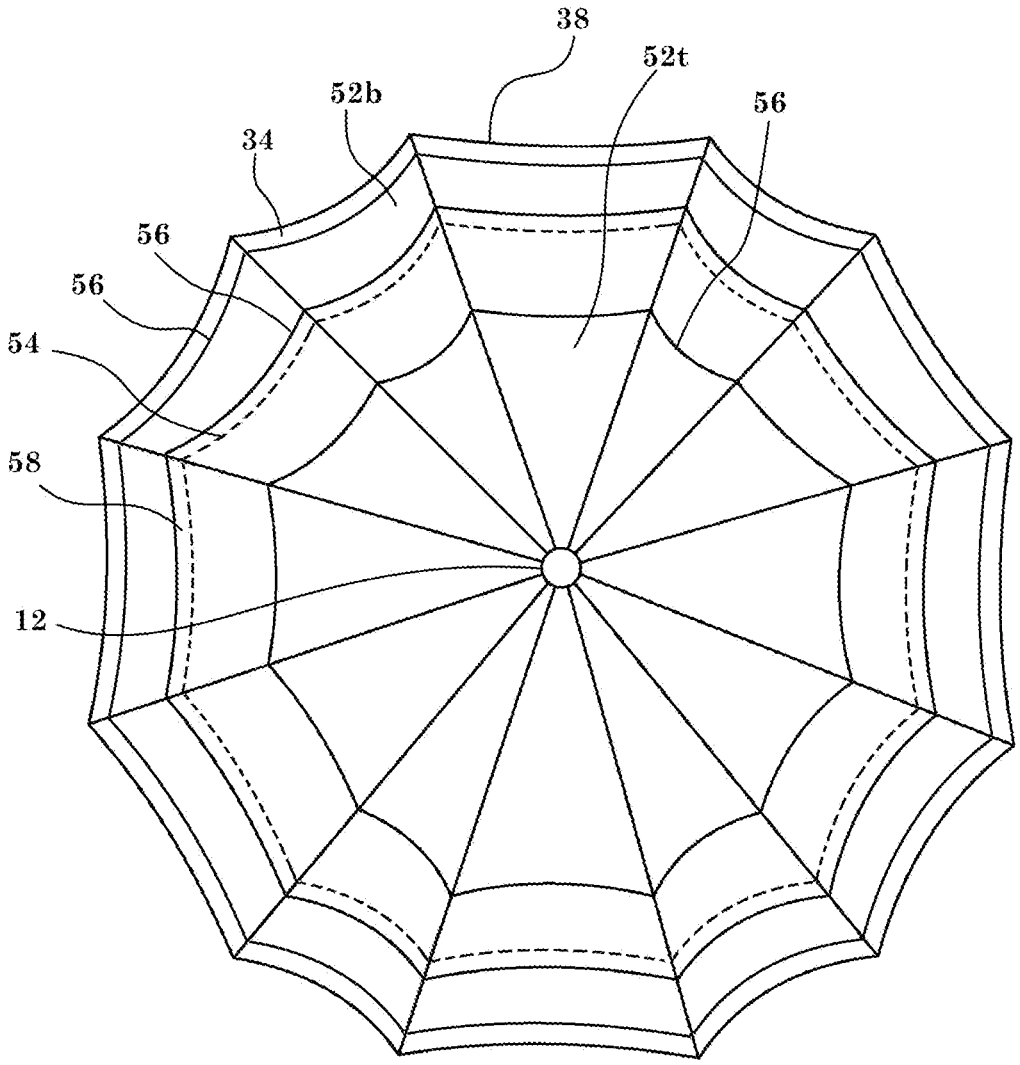
FIG. 5 is a top plan view of the vented canopy system presented in FIG. 3.

As best seen in FIG. 5, the VCS 10 may further comprise a canopy section comprising a plurality of canopy layers 52 disposed on top of the breathable support layer 44. Each canopy layer 52 may define an inner canopy layer perimeter 54 and an outer canopy layer perimeter 56. Each canopy layer 52 may cover a portion of canopy opening 42, with an upper canopy layer overlapping a lower canopy layer by a canopy layer overlap distance 58. The bottom canopy layer 52*b* overlaps said trim section 34 by a trim section overlap distance 60 (FIG. 2), and the top canopy layer inner perimeter 54*t* may be configured to attach to the umbrella frame 10 at a canopy interface point 21 near the support element 12. One of ordinary skill in the art will appreciate that the top canopy layer 52*t* may have a slightly different design than the other canopy layers 52 as the inner canopy layer perimeter 54*t* may define a diameter similar to the support layer inner perimeter 48. Generally speaking, the canopy width, measured as the distance from the inner canopy layer perimeter 56 and the outer canopy layer perimeter 58, may be about 5 feet to about 10 feet. For this document, "about" is +/−10%.

For yet another embodiment, a canopy section is provided comprising a plurality of canopy layers 52 disposed on top of the air permeable support layer 44 wherein each canopy layer 52 defines a canopy layer inner perimeter 54 and a canopy layer outer perimeter 56 thereby defining a canopy layer width therebetween. Such canopy layer width may be shorter than the canopy opening 42, and thus, cover only a portion of the canopy opening 42. The plurality of canopy layers 52 may be arranged in a layered configuration from a bottom layer 52*b* to a top layer 52*t* so that the canopy layer outer perimeter 56 for each canopy layer 52 extends over an adjacent and lower canopy layer a predefined canopy layer overlap distance 58. The canopy layer inner perimeter 54 for each canopy layer 52 may be configured for being connected to the umbrella frame 10 with the canopy layer inner perimeter 54 for the top canopy layer being configured to be connected to the umbrella frame 10 at the central pole element 12. The canopy layer outer perimeter 54 for the bottom canopy layer 52*b* may be configured to extend over the canopy trim 34 a predefined trim overlap distance 60 so that the canopy sections cover the canopy opening 42.

As best seen in FIG. 7, the VCS 32 may further comprise a plurality of tethers 62 for connecting the outer canopy layer perimeters 56 to at least one of the umbrella frame 10 or a lower canopy layer 52. The tethers 62 may be configured to allow its associated canopy layer 52 to flip up when subjected to wind while preventing the canopy layer 52 from flipping all the way over. The tethers 62 may define a first tether end 64 and an opposing second tether end 66, with the distance therebetween defining a tether length 68. The first tether end 64 may be connected to lower canopy layer 53 and/or support arms 20. The second tether end 66 may be connected to a canopy layer 52 near or at the outer canopy layer perimeter 56, and perhaps to a canopy rod 70 as described below (FIG. 8). A second tether end 66 may connect to a support arm 20 or a lower canopy layer 52. When connected to a lower canopy layer 52 as depicted in FIG. 9, an upper canopy layer 52 may help pull up on a lower canopy layer 52. Such a configuration allows the canopy layer 52 to return to its original configuration when the winds disperse. The term "original configuration" does not mean perfect alignment, just a layer configuration similar to the original configuration. Suitable materials for the tethers 62 include flexible wire material, a string material, a single strand and a material such as nylon, fluorocarbon, and polyethylene.

Still referring to FIGS. 7, 8, and 9, the VCS 32 may further include a plurality of canopy layer support rods 70. Each support rod 70 may define a first rod end 72 that may connect to the inner canopy layer perimeter 54 and a second rod end 74 that may connect to the outer canopy layer perimeter 56 of a canopy layer 52, with the distance between these points defining the rod's length 76. The canopy layer 52 may include rod receivers 78 (FIG. 8) designed to hold the support rods 70. These rods may provide additional support to the canopy layers 52 as they rise during wind gusts. Ideally, the support rod length 76 should be slightly less than or equal to the width of its associated canopy layer 52. For example, a canopy layer 52 with a 6-foot width would ideally have 6-foot support rods 70.

One of ordinary skill in the art will appreciated that for the VCS 32 described above, the size of the canopy opening 42, the permeability of the breathable support layer 44 and the length of the plurality of tethers 62 are selected to allow a predefined amount of airflow through said canopy opening so that the canopy will not take flight daringly abnormally high gusts of wind (as well as normal wind gusts). Exemplary dimensions include trim width of about (+/−10%) 4 to 6 inches and canopy layer widths (distance between said outer trim perimeter and said inner trim perimeter) of between about 3 to 10 feet, which is also the ideal support rod length 76 variance. Exemplary lengths for the tethers can vary between about 6 to 18 inches. The overlap values may also have some influence on how consistently the layers return to their original positions. Exemplary overlap measurements include a canopy overlap distance of about 4 to 6 inches and a trim overlap distance 60 of about 2 to 5 inches.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A vented canopy system configured to be mechanically connected to an umbrella frame, said vented canopy system comprising:

a canopy trim configured for being connected to a umbrella frame having a central pole element with a plurality of support arms extending outward from the central pole element to support arm ends thereby defining a frame outer edge, wherein said canopy trim defines a inner trim perimeter and an outer trim perimeter and wherein said canopy trim is configured to connect to the frame outer edge so that said inner trim perimeter extends over a portion of the frame outer edge and wherein a canopy opening is defined by said inner trim perimeter;

an air permeable support layer defining a support layer inner perimeter and a support layer outer perimeter wherein said support layer inner perimeter is configured to be connected to the umbrella frame at the central pole element and extend over said canopy opening and connect to at least one of said inner trim perimeter or the umbrella frame at a point between said inner trim perimeter and said outer trim perimeter;

a first canopy layer disposed on top of said support layer wherein said first canopy layer defines a first layer canopy inner perimeter and a first canopy layer outer perimeter with the distance there between defining a first canopy layer width and wherein said first canopy layer inner perimeter is connected to the umbrella frame at the central pole element and extends outward until it extends over said inner trim perimeter a predefined first layer overlap distance thereby covering said canopy opening;

a plurality of support rods, each having a first rod end connected to said first canopy layer at said first canopy layer inner perimeter and an opposing second rod end connected at said first canopy layer outer perimeter and wherein said plurality of support rods extend away from said first canopy layer inner perimeter;

a plurality of tethers, each defining a first tether end and an opposing second tether end and wherein said first tether end for each said tether is connected to one of said plurality of support rods at said second support rod end and wherein said second tether end is connected to one of said canopy trim, said support layer, or the umbrella frame, wherein said length of each tether is selected to allow said first canopy layer to flip up when subjected to a gust of wind while preventing said first canopy layer from flipping over so that said first canopy layer returns to its original configuration when the gust of wind is no longer present; and wherein the size of said canopy opening, the permeability of said permeable support layer, and said length of said plurality of tethers are selected to allow a predefined amount of airflow through said canopy opening.

2. The vented canopy system, as in claim 1, wherein said outer trim perimeter hangs over the umbrella support structure's structural perimeter.

3. The vented canopy system, as in claim 2, wherein the distance between said outer trim perimeter and said inner trim perimeter is between 4 to 7 inches.

4. The vented canopy system, as in claim 1, wherein said first canopy layer width is between about 6 feet to 13 feet.

5. The vented canopy system, as in claim 4, wherein said first canopy layer outer perimeter extends over said inner trim perimeter between 2 to 5 inches.

6. The vented canopy system, as in claim 1, wherein said length of each of said tethers is less than or equal to said first canopy layer width.

7. The vented canopy system, as in claim 6, wherein said plurality of tethers are made from one of a string or a fishing line material.

8. The vented canopy system, as in claim 6, wherein said plurality of tethers are made from a flexible wire material.

9. The vented canopy system, as in claim 1, where said support layer is made from at least one of a cargo netting, knotted netting, knotless netting, polyester debris fabric, shade cloth, or a mesh fabric material.

10. A vented canopy system for an umbrella frame, said vented canopy system comprising:

a canopy trim configured for being connected to a umbrella frame having a central pole element with a plurality of support arms extending outward from the central pole element to support arm ends thereby defining a frame outer edge, wherein said canopy trim defines a inner trim perimeter and an outer trim perimeter and wherein said canopy trim is configured to connect to the frame outer edge so that said inner trim perimeter extends over at least portion of the frame outer edge and wherein a canopy opening is defined by said inner trim perimeter;

an air permeable support layer defining a support layer inner perimeter and a support layer outer perimeter wherein said support layer inner perimeter is configured to be connected the umbrella frame at the central pole element and extend over said canopy opening and connect to at least one of said inner trim perimeter or the umbrella frame at a point between said inner trim perimeter and said outer trim perimeter;

a canopy section comprising a plurality of canopy layers disposed on top of said air permeable support layer wherein each canopy layer defines a canopy layer inner perimeter and a canopy layer outer perimeter thereby defining a canopy layer width therebetween that is shorter than said canopy opening and wherein said plurality of canopy layers are arranged in a layered configuration form a bottom layer to a top layer so that said canopy layer outer perimeter for each canopy layer extends over an adjacent and lower canopy layer a predefined canopy layer overlap distance, and wherein said canopy layer inner perimeter for each canopy layer is configured for being connected to the umbrella frame with said canopy layer inner perimeter for said top canopy layer being configured to be connected to the umbrella frame at the central pole element and wherein said canopy layer outer perimeter for said bottom canopy layer is configured to extend over said canopy trim a predefined trim overlap distance so that said canopy section covers said canopy opening;

a plurality of tethers for connecting said canopy layer outer perimeter for each said canopy layer to the umbrella frame, wherein said plurality of tethers are configured to allow said plurality of canopy layers to flip up when subjected to wind while preventing said canopy layer from flipping all the way over; and wherein the size of said canopy opening, the permeability of said permeable support layer, the said canopy layer widths, and the length of said plurality of tethers are selected to allow a predefined amount of airflow through said canopy opening.

11. The vented canopy system for an umbrella frame, as in claim 10, further comprising a plurality of canopy layer support rods, wherein each support rod is configured to connect to one of said plurality of canopy layers.

12. The vented canopy system for an umbrella frame, as in claim 10, wherein the distance between said outer trim perimeter and said inner trim perimeter is between 4 to 7 inches.

13. The vented canopy system for an umbrella frame, as in claim 10, wherein said canopy layer widths can vary between about one foot to six feet.

14. The vented canopy system for an umbrella frame, as in claim 10, wherein said trim overlap is between two inches to five inches and said predefined canopy overlap distance is between four inches to six inches.

15. The vented canopy system for an umbrella frame, as in claim 10, wherein the length of said tethers can vary between about six to twelve inches and are made from one of a flexible wire material, a string material, a single strand or a braided material such as nylon, fluorocarbon, and polyethylene.

16. The vented canopy system for an umbrella frame, as in claim 10, where said support layer is made from at least one of a cargo netting, knotted netting, knotless netting, polyester debris fabric, shade cloth, or a mesh fabric material.

17. A vented canopy system for an umbrella frame, said vented canopy system comprising:

a trim section configured to attach to the outer frame edge defined by an umbrella frame having a central support pole with support arms extending therefrom, thereby defining the outer frame edge;

an inner trim perimeter that extends partially over the outer frame edge thereby defining a canopy opening between said inner trim perimeter and the central support pole when said canopy system is connected to the umbrella frame;

a breathable support layer configured to attach to the umbrella frame at the central support pole and expand outward over said canopy opening and connect to at least one of said inner trim perimeter or a portion of the umbrella frame under said trim section, wherein said breathable support layer is configured to allow air to pass through and provide support to upper canopy layers;

a plurality of canopy layers disposed on top of said breathable support layer wherein one canopy layer defines a top canopy layer and with the remainder of said plurality of canopy layers defining lower canopy layers, wherein each of said lower canopy layers define an inner lower canopy layer perimeter and an outer lower canopy layer perimeter with the distance therebetween define lower canopy layer widths and wherein said top canopy layer defines a top canopy layer inner perimeter and top layer outer perimeter with the distance therebetween defining the top canopy layer width;

wherein each of said plurality of canopy layers covers a portion of said canopy opening with upper canopy layers overlapping adjacent lower canopy layers by a canopy layer overlap distance and wherein one of said plurality of canopy layers overlaps said trim section by a trim section overlap distance and wherein said top canopy layer inner perimeter is configured to attach to the umbrella frame at the central support pole and wherein said inner lower canopy layer perimeters are configured to be connected to the umbrella frame between the central support pole and the outer frame edge;

a plurality of tethers for connecting said outer perimeters of each of said plurality of canopy layers to one of the umbrella frame or an adjacent canopy layer, wherein said plurality of tethers are configured to allow said plurality of canopy layers to flip up when subjected to wind while preventing said plurality of canopy layers from flipping all the way over; and wherein the size of said canopy opening, the permeability of said breathable support layer, said canopy layer widths, and the length of said plurality of tethers are selected to allow a predefined amount of airflow through said canopy opening.

18. The vented canopy system for an umbrella frame, as in claim 10, further comprising a plurality of canopy layer support rods wherein each support rod is configured to connect to one of said plurality of canopy layers.

19. The vented canopy system for an umbrella frame, as in claim 11, wherein the distance between said outer trim perimeter and said inner trim perimeter is between 4 to 6 inches.

20. The vented canopy system for an umbrella frame, as in claim 10, wherein said canopy layer widths can vary between about 12 inches and 16 inches and said predefined canopy overlap distance is between 4 to 6 inches and wherein said length of said tethers can vary between about 6 to 12 inches and are made from one of a flexible wire material, a string material, a single strand or material including nylon, fluorocarbon, and polyethylene.

* * * * *